US007488227B2

(12) United States Patent
Fujima et al.

(10) Patent No.: US 7,488,227 B2
(45) Date of Patent: Feb. 10, 2009

(54) OUTBOARD ENGINE UNIT

(75) Inventors: Akifumi Fujima, Wako (JP); Toshiyuki Watanabe, Wako (JP); Koji Kuriyagawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 7 days.

(21) Appl. No.: 11/742,857

(22) Filed: May 1, 2007

(65) Prior Publication Data

US 2007/0251488 A1 Nov. 1, 2007

(30) Foreign Application Priority Data

May 1, 2006 (JP) ..... 2006-127623

(51) Int. Cl.
*B63H 20/32* (2006.01)
*F02B 61/04* (2006.01)

(52) U.S. Cl. ..... 440/77; 123/195 P

(58) Field of Classification Search ..... 440/77
See application file for complete search history.

(56) References Cited

U.S. PATENT DOCUMENTS

| | | | | |
|---|---|---|---|---|
| 5,207,186 | A * | 5/1993 | Okita | 123/41.31 |
| 5,809,974 | A | 9/1998 | Osakabe | |
| 6,045,421 | A * | 4/2000 | Hiraoka et al. | 440/77 |
| 6,334,420 | B1 | 1/2002 | Yoshikawa et al. | |
| 2004/0149241 | A1 | 8/2004 | Shomura et al. | |

FOREIGN PATENT DOCUMENTS

| | | |
|---|---|---|
| JP | 10223111 | 8/1998 |

OTHER PUBLICATIONS

European Search Report dated Jul. 10, 2007, Application No. 07008787.9-1231.

* cited by examiner

*Primary Examiner*—Jesus D Sotelo
(74) *Attorney, Agent, or Firm*—Westerman, Hattori, Daniels & Adrian, LLP.

(57) ABSTRACT

An outboard engine unit having plural electronic components is disclosed. The electronic components are wholly supported by a single bracket which is mounted to a crankcase through a vibration damping rubber grommet.

3 Claims, 7 Drawing Sheets

OUTBOARD ENGINE UNIT

FIELD OF THE INVENTION

The present invention relates generally to an outboard engine unit and, more particularly, to an outboard engine unit having an improved mounting structure for electronic components of the outboard engine unit.

BACKGROUND OF THE INVENTION

An outboard motor wherein a plurality of electrical or electronic components with relays is accommodated in a single relay box is known from, for example, Japanese Patent Laid-Open Publication No. 10-223111 (JP 10-223111 A).

In the outboard motor disclosed in JP 10-223111 A, the relay box is secured to an under case via a vibration-resist rubber member. The under case is mounted to a mount case through an anti-vibration rubber member.

Each of the plural electronic components is enclosed in a respective resinous case. The resinous cases enclosing the electronic components are accommodated in the single relay box. As a result, the resinous cases require a respective support member. That is, for supporting the plural electronic components, plural support structures are required.

In recent years, many of under covers of engine covers are made of a resin material. In this instance, the electronic components are assumed to be mounted to an engine that serves as a source of vibrations. Thus, it is necessary to arrange for vibrations of the engine from being transmitted directly to the electronic components.

Consequently, there are a demand for an arrangement that protects electronic components, which are mounted to an engine or an engine support member, from vibrations, and a demand for an arrangement that achieves simplifies mounting of plural electronic components.

SUMMARY OF THE INVENTION

According to the present invention, there is provided an outboard engine unit comprising: an engine; a plurality of electronic components; and a sole bracket for supporting the plural electronic components inclusive, wherein the bracket is mounted via a rubber mount to the engine or an engine support member.

The plural electronic components, including a relay switch having an electrical contact, are thus mounted via the rubber mount (grommet) to the engine as a source of vibration. As a result, an electronic component mounting structure with increased vibration damping capability is provided. Further, by virtue of the bracket that singly supports the plural electronic components, it becomes possible to reduce the number of parts and man hours required for mounting electronic components and to achieve efficient mounting of the electronic components.

In a preferred form, one of the plural electronic components comprises an electric contact accommodated within a fluid keeping case. By virtue of the fluid and the rubber mount vibration damping structure, vibration damping of the electrical contact is achieved with increased efficiency.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
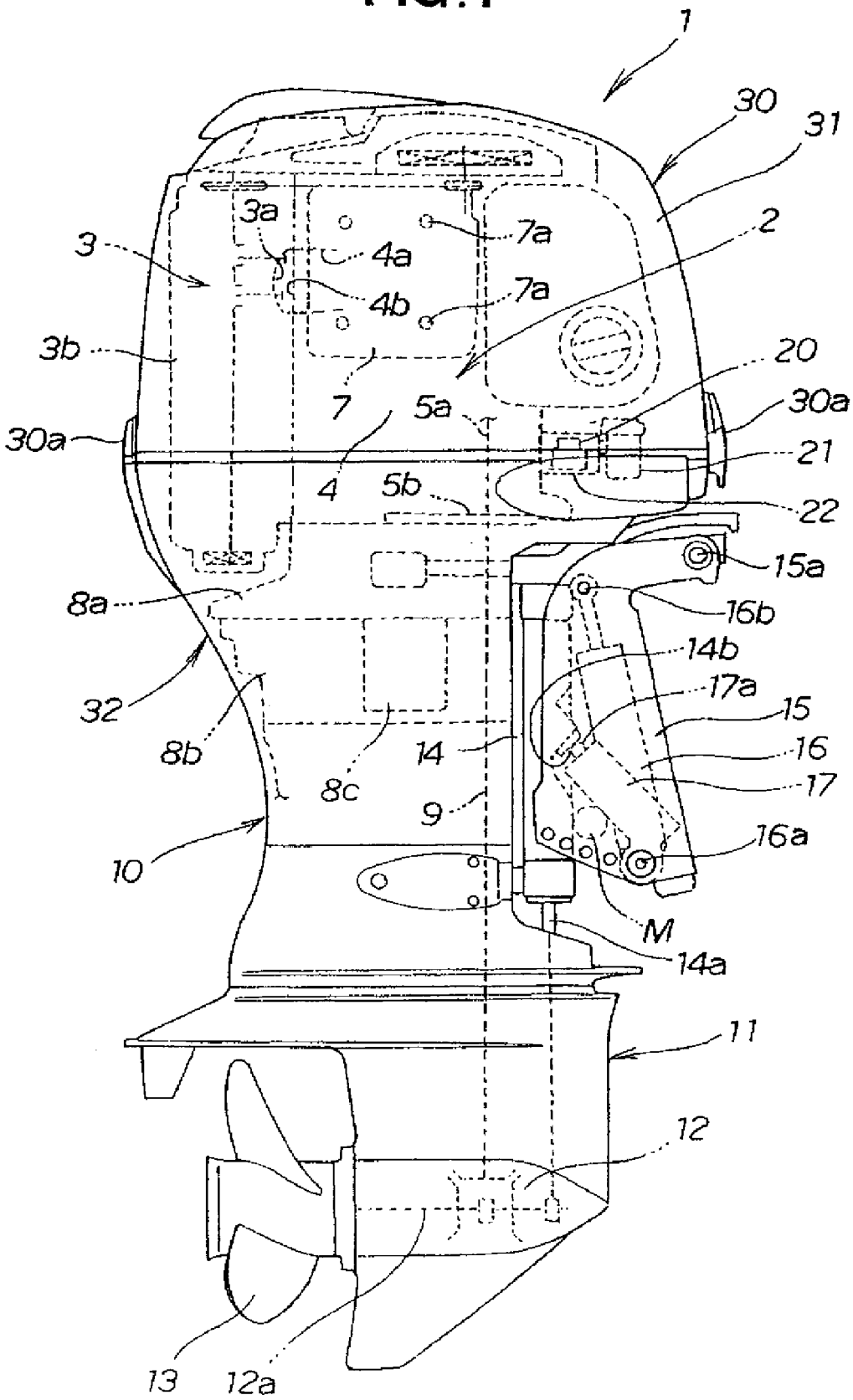
FIG. 1 is a side elevational view illustrating an outboard engine unit according to the present invention.
Figure 2:
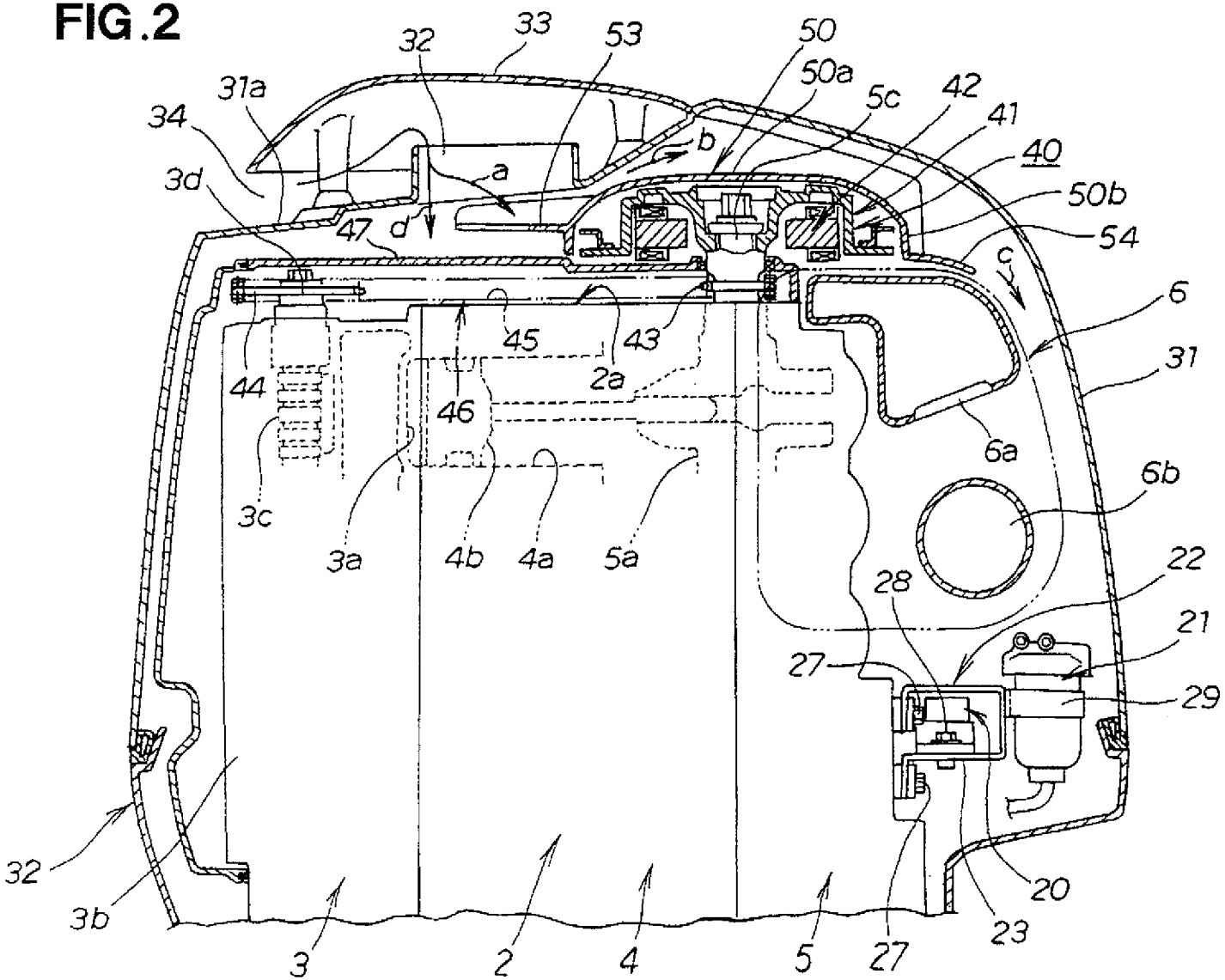
FIG. 2 is a cross-sectional view illustrating an upper part of the outboard engine unit shown in FIG. 1.
Figure 3:
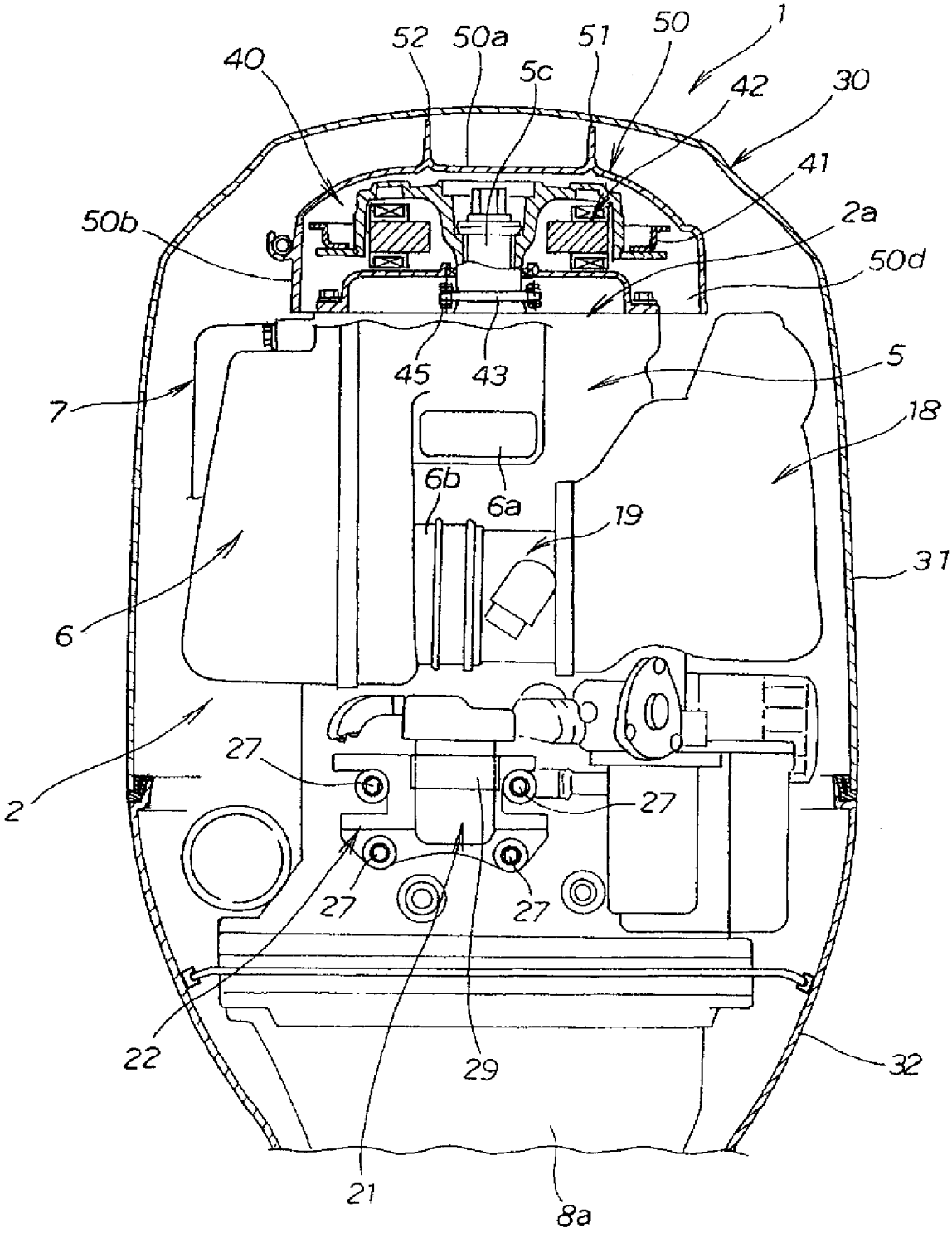
FIG. 3 is a partial cross-sectional view illustrating the outboard engine unit upper part of FIG. 2 as viewed from forward.

As shown in FIGS. 1 through 3, an outboard engine unit (outboard motor) 1 comprises an engine covered by an engine cover 30.

The engine 2 comprises a four-stroke multi-cylinder engine having a piston movable substantially horizontally and a crankshaft disposed vertically. The engine 2 also comprises a cylinder block 4, cylinder head 3 disposed on a rear part of the cylinder block, and a crankcase 5 disposed on a front part of the cylinder block 4. The cylinder head 3 has a plurality of combustion chambers 3*a* and is covered by a cylinder head cover 3*b*. The cylinder block 4 has a plurality of cylinders 4*a* and a plurality of pistons 4*b* corresponding to the cylinders 4*a*. The crankcase 5 accommodates the vertical crankshaft 5*a*. The cylinder block 4 and the crankcase 5 jointly form an engine block.

Electronic component box 7 is secured, via bolts 7*a*, to a right side of the engine block 4 forming the engine 2. The electronic component box 7 accommodates electronic control devices and so forth that control engine ignition and fuel injection.

Figure 4:
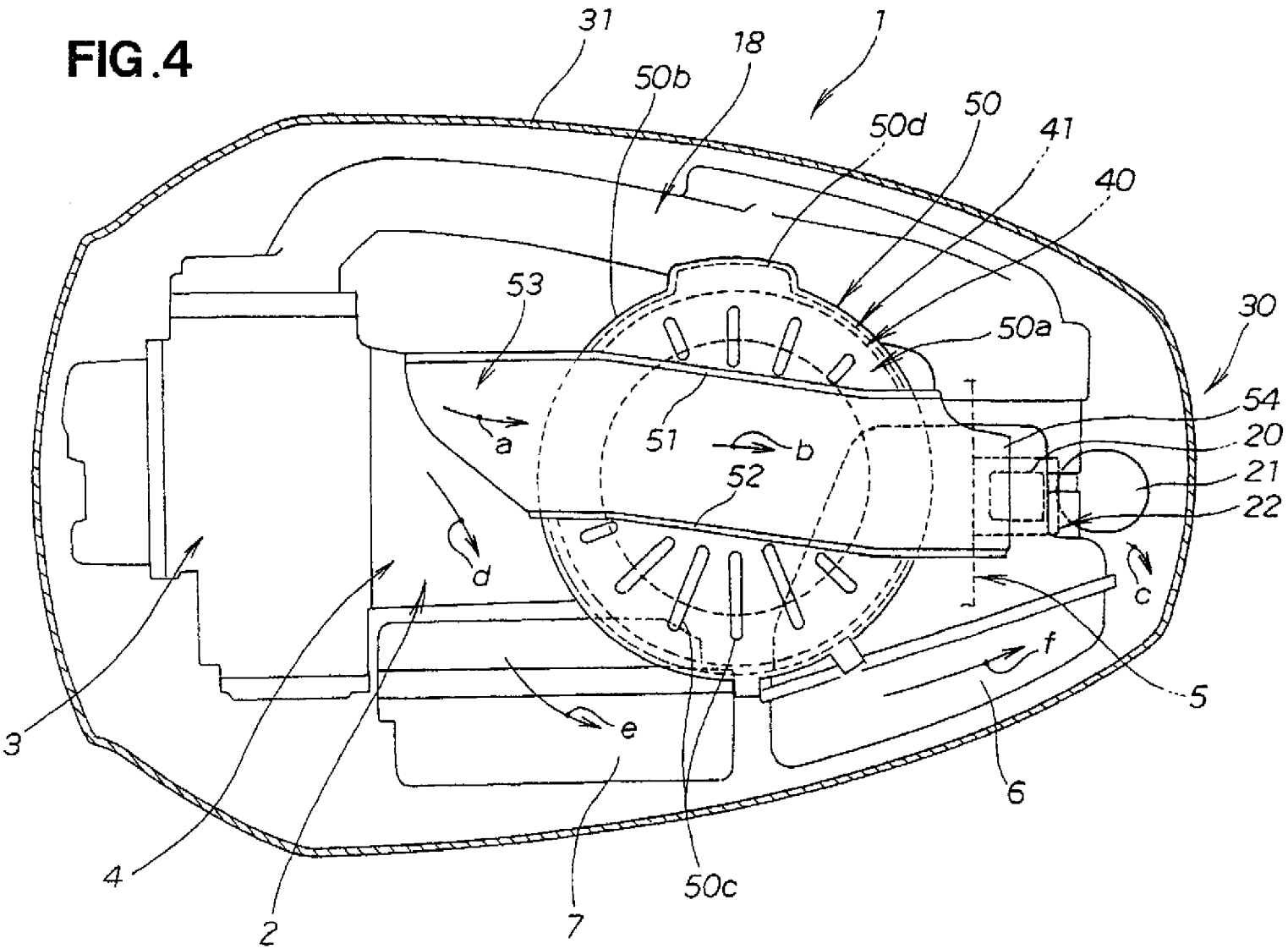
FIG. 4 is a top plan view illustrating the outboard engine unit upper part of FIG. 2 with an upper cover sectioned.

As shown in FIG. 4, an intake silencer 6 is provided on a right side of the crankcase 5 while the electronic component box 7 is provided on a right side of the cylinder block 4 and positioned rearwardly of the intake silencer.

Engine 2 is covered by an engine cover 30 which is comprised of an upper cover 31 for covering an upper part of the engine 2 and a lower cover 32 for covering a lower part of the engine 2. Engine space is defined jointly by the upper and lower covers 31, 32. The upper cover 31 is capable of opening/closing actions relative to the lower cover 32 through operations of lock levers 30*a*, 30*a* provided on front and rear parts of the outboard engine unit, so that maintenance and repair operations can be carried out on the engine 2.

The engine 2 is supported by a mount case 8*a*. An oil case 5*b* which accommodates an oil pan 8*c* is connected to an underside of the mount case 8*a*.

The vertically extending crankshaft 5*a* includes a flywheel 5*b* at a lower end thereof and is connected to a drive shaft 9 extending downwardly. The drive shaft 9 extends through an extension case 10, provided downwardly of and continuously with the lower cover 32, and is connected to a gear transmission mechanism 12 enclosed in a gear case 11 which in turn is connected to a lower end of the extension case 10.

The gear transmission mechanism 12 is provided to transmit a drive force from the drive shaft 9 to a horizontal drive shaft 12*a*. A rear end of the horizontal drive shaft 12*a* projects rearwardly out of the gear case 11. A propeller 13 is mounted to a rear end of the horizontal drive shaft 12*a*. The propeller 13 is driven by motive power of the engine 2. The outboard engine unit 1 is imparted with propulsion for forward and backward travel by switching between normal rotation and reverse rotation of the propeller 13 with a pair of dog clutches not shown.

Swivel case 14 is provided between a front part of the mount case 8*a* and a front lower part of the extension case 10. The outboard engine unit 1 is supported horizontally swingable about a swivel shaft 14*a* in the swivel case 14. A body of the outboard engine unit, which is formed by the engine 2, mount case 8*a*, oil case 8*b*, extension case 10 and gear case 11, is supported on the swivel shaft 14*a* via a vibration-resistant rubber, not shown.

The outboard engine unit 1 is adapted to be mounted to a stern of a boat via a stern bracket 15 such that it is vertically movable about a tilt shaft 15*a*.

Designated by reference numeral 16 is a tilt cylinder 16 which has a proximal end rotatably connected to the stern bracket 15 via a shaft 16*a* and a distal end rotatably connected to the swivel case 14 via a shaft 16*b*.

Trim cylinder 17 has a proximal end which is rotatably connected to the stern bracket 15. The trim cylinder 17 also has a rod 17*a* with a distal end held in contact with a receptive part 14*b* of a swivel case 14.

By virtue of the trim cylinder 17, the boat can carry out a trim operation from the start to normal state of sailing. When it is not in use, the outboard engine unit 1 tilts up via the tilt cylinder 13.

Trim/tilt apparatus includes a hydraulic device, formed by the tilt cylinder 16 and the trim cylinder 17, and an electric motor M for driving the hydraulic device. The electric motor is drive-controlled by electronic component or equipment.

As shown in FIGS. 2 and 3, the crankshaft 5*a* has an upper part 5*c* which projects upwardly of the boundary between the cylinder block 4 and the crank case 5. A drive sprocket 43 is mounted to a lower part of the upper part projection 5*c*. A driven sprocket 44 is mounted to an upper end 3*d* of the camshaft 3*c* vertically disposed within the cylinder head 3. The upper end 3*d* projects upwardly from an upper surface 2*a* of the engine block. A silent chain 45 is trained around the drive and driven sprockets 43, 44.

A camshaft drive mechanism 46 for driving the camshaft 3*c* is comprised of the drive sprocket 43, the driven sprocket 44 and the chain 45.

Since the camshaft drive mechanism 46 requires lubricating oil, there is possibility that oil will spatters around. Thus, the camshaft drive mechanism 46 is covered by a chain cover 47 disposed above the upper surface 2*a* of the engine 2.

Designated by reference numeral 40 is an alternate current generator (ACG) which is mounted to the upper part 5*c* of the crankshaft 5*a* and generates alternate current by the rotational drive of the crankshaft 5*a*. The generator 40 is comprised of an inverted-cup-shaped rotor 41 with a magnet disposed around a periphery of the rotor 41, and a generating coil 42 wound around a core.

The generator 40 is covered by a cap-shaped generator cover 50 as shown in FIG. 4. The generator cover 50 is comprised of a dome-shaped ceiling part 50*a* and a peripheral wall 50*b*. The ceiling part 50*a* has right and left guide walls 51, 52 extending in a front-to-rear direction in spaced apart relation to each other. Between the guide walls, the ceiling part 50*a* has a rear projection 53 projecting rearwardly and a front projection 54 projecting forwardly up to a front upper part of the intake silencer 6.

The ceiling part 50*a* has a plurality of airinlets 50 for introducing cooling air into inside the generator cover 50 for cooling the generator 40. On the peripheral part 50*b* of the generator cover 50, a duct 50*d* is disposed in opposed relation to the intake silencer 6 and the electronic component box 7 and above an inlet manifold 18 for discharging hot air resulted from cooling the generator 40.

As shown in FIG. 2, the upper cover 31 of the engine cover 30 has a recessed part 31*a* formed in a rear half thereof and an outside air inlet 32 formed in a mid-part in a front-and-rear direction of the recessed part 31*a* and opening upwardly.

A lid 33 is disposed above the outside air inlet 32 formed in the rear half of the upper cover 31. An opening 34 is defined between the lid 33 and the recessed part 31*a* of the upper cover 31 for allowing outside air to enter inside the engine cover 30. Outside air is introduced through the opening 34 and the outside air inlet 32 into inside the engine cover 30.

As shown in FIGS. 2 and 3, the intake silencer 6, which is box-shaped, is disposed in a right side part of the crankcase 5 such that it occupies an area of the right side part spanning from a front part to a forward part of the latter.

The intake silencer 6 has an intake port 6*a* for introducing outside air into inside the engine cover 30. The intake port 6*a* is provided on a surface other than surfaces opposed to the engine 2 and hence to the crankcase 5. In the illustrated example, the intake port 6*a* is provided in such a manner as to open downwardly. The intake silencer 6 also has a discharge port 6*b* disposed below the intake port 6*a* for discharging the outside air introduced through the intake port 6*a* toward a throttle valve apparatus 19. The discharge port 6*b* communicates with an introductory part of the throttle valve apparatus 19 which forms part of a fuel supply apparatus, not shown. Outside air introduced through the intake port 6*a* is fed to the throttle valve apparatus 19 and then to the inlet manifold 18.

Part of the wall of the intake silencer 6 suppresses direct entry into the intake port 6*a* of the air comprised of air which became hot as a result of cooling the generator 40.

As shown in FIG. 2, outside air flows into inside the engine cover 30 through the opening 34 defined by the upper cover 31 and the lid 33 and through the outside air inlet 32 formed in the upper cover 31. The outside air flew past the outside air inlet 32 flows to above a rear projection 53 of the generator cover 50, as shown by arrow a, flows between the right and left guide walls 51, 51 of the generator cover 50, as shown by arrow b, and flows through a front projection of the generator cover 50 into a forward position of the intake silencer 6, as shown by arrow c. Thereafter, the outside air flows through the intake port 6*a* of the intake silencer 6 into the intake silencer 6 and then into the throttle valve apparatus 19, where it is mixed with a fuel and fed to the inlet manifold 18.

As shown in FIGS. 2 and 4, the outside air flew past the outside air inlet 32 also flows over and alongside the electronic component box 7 and the intake silencer 6 into a space around the engine 2, as shown by arrows d, e and f.

Figure 5:
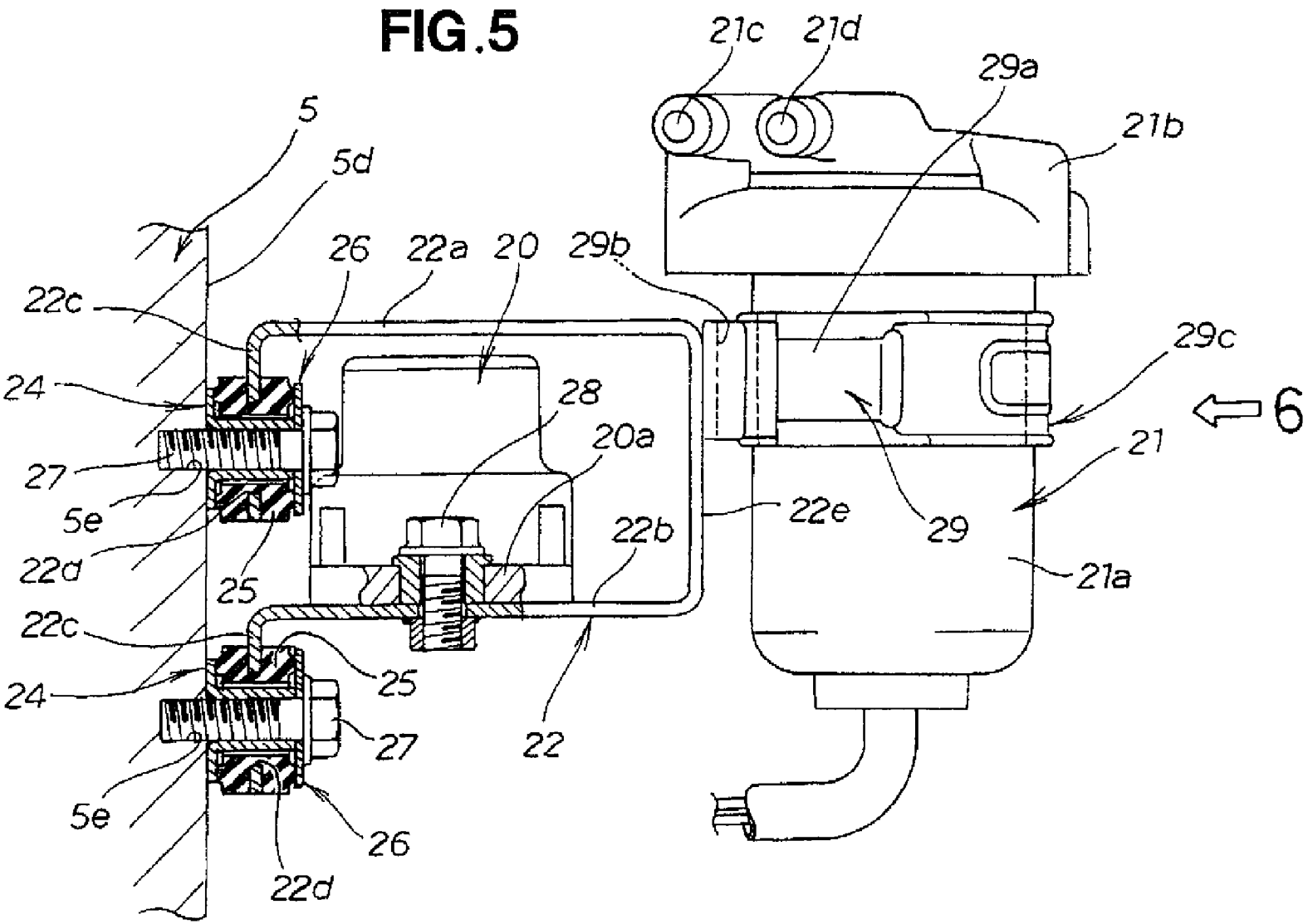
FIG. 5 is an enlarged view illustrating electronic components and a water separator shown in FIG. 2.
Figure 6:
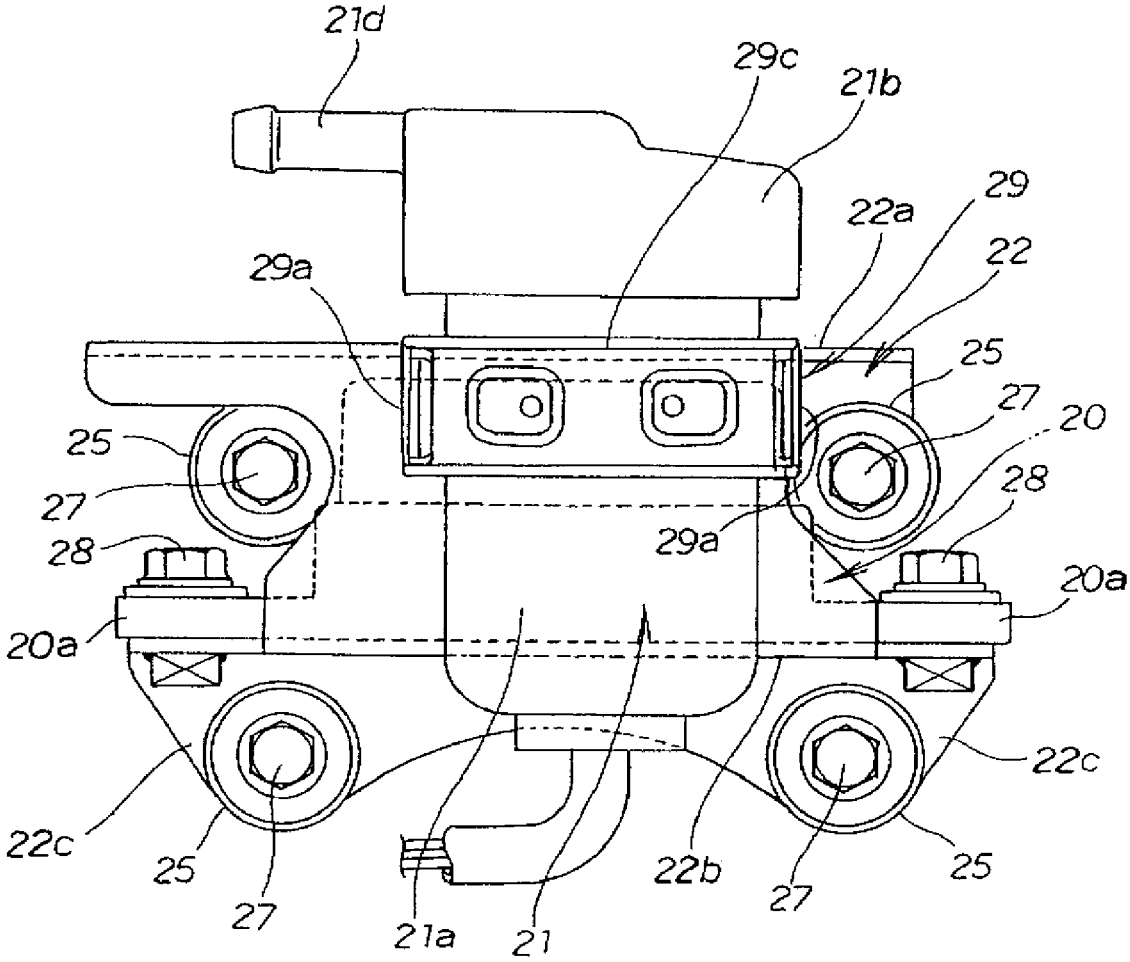
FIG. 6 is a front elevational view illustrating the electronic components and water separator as viewed from arrow 6 of FIG. 6.
Figure 7:
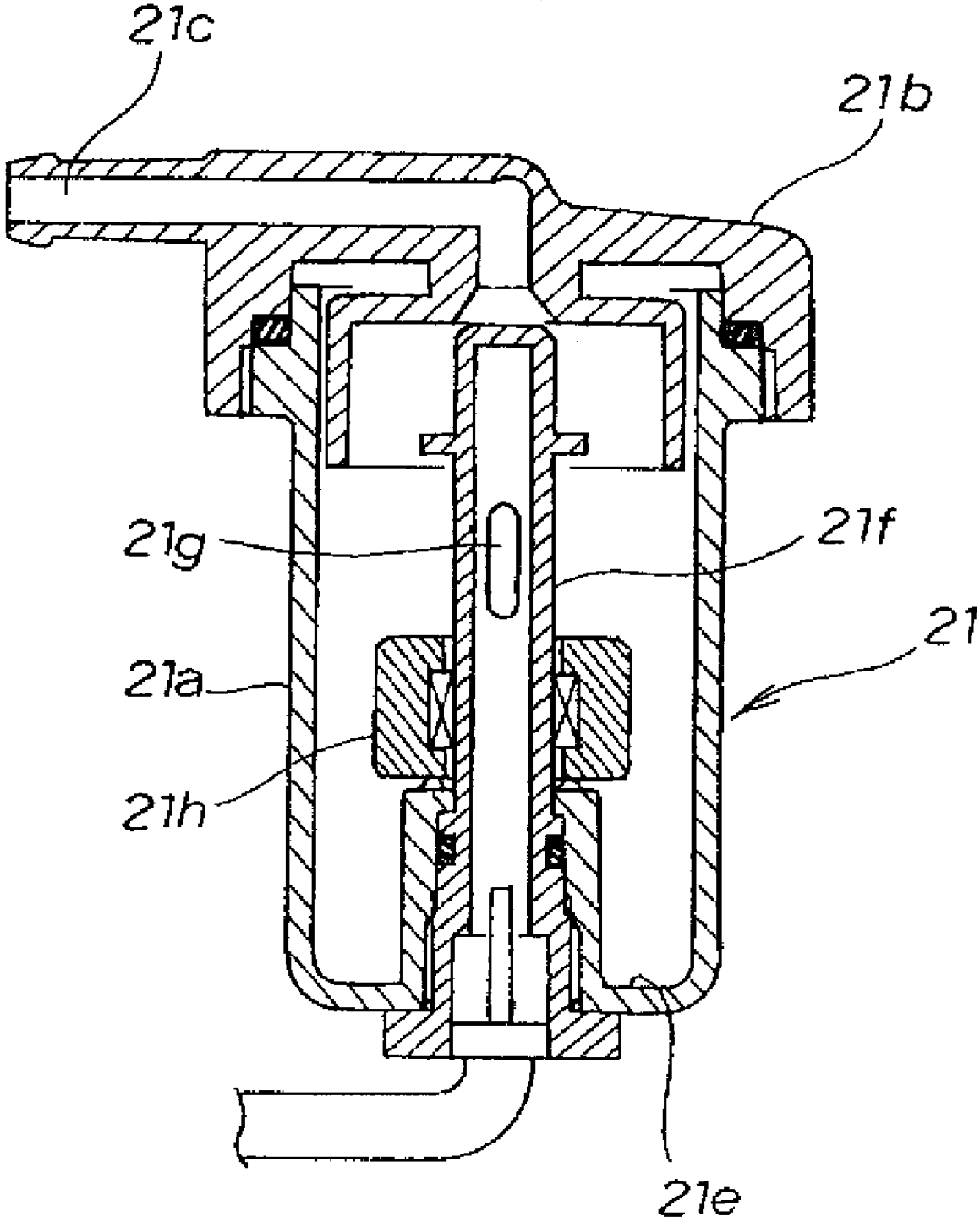
FIG. 7 is a cross-sectional view illustrating the water separator shown in FIG. 5.

Referring now to FIGS. 5 through 7, discussion will be made next as to the electronic components (equipment) 20 for controlling the electric motor that drives the tilt cylinder 16 and the trim cylinder 17, and as to a water separator 21 for separating water from a fuel.

The electronic components 20 and the water separator 21 are mounted to a front wall 5*d* of the crankcase 5 such that they are positioned below the intake port 6*a* of the intake silencer 6, as shown in FIG. 2.

The electronic components 20 include a pump and a relay switch, the pump being for effecting normal- and counter-drive of the hydraulic apparatus which is comprised of the tilt cylinder 16 and the trim cylinder 17, the relay being for the electric motor. The electronic components 20 loathe heat and hence should be kept in an environment that is free from a temperature being increased rapidly. Further, the electronic components 20 require vibration damping.

It is desirable that both the electronic equipment 20 and the fuel water separator 21 be supported at a single position within the engine unit to thereby simplify the support arrangement for them and to reduce the number of required parts and man hours.

As shown in FIGS. 5 and 6, a bracket 22 for supporting the electronic equipment 20 and the fuel water separator 21 is made by press-forming a steel sheet and is U-shaped as viewed in side elevation with right and left side being opened.

The support bracket 22 includes an upper wall 22*a* and a lower wall 22*b* with their opposite ends having downwardly bent mounting parts 22*c* (totally four) for mounting the bracket to the front wall 5*d* of the crankcase 5.

Each of the mounting parts 22*c* has a fitting hole 22*d* within which a vibration damping rubber grommet 25 is to be fitted. A bush 24 is fitted into the grommet 25. Then, a bolt 27 is threadedly engaged in a threaded hole 5*e* formed in a front wall 5*d* of the crankcase 5 with a washer 26 disposed in-between to thereby fixedly secure the bracket 22 to the front surface of the crankcase 5. Thus, the bracket 22 is supported via the rubber grommet 25 vibration-freely by a vibration source, namely, the engine.

The electronic equipment 20 has at its lower part a mounting flange 20*a* extending in a right-and-left direction and mounted via a bolt 28 to a lower wall 22*b* of the bracket 22 with the result that the equipment 20 is mounted within the bracket 22.

The fuel water separator 21 is mounted to a front wall 22*e* of the bracket 22 via an arm member 29. Front part and upper and lower parts of the arm member are opened to form a U-shape as viewed in top plan.

Body 21*a* of the water separator 21 is sandwiched between right and left side walls 29*a*, 29*a* of the arm member 29. That is, rear surface and right and left side surfaces of the body 21*a* are enclosed by a rear wall 29*b* and the right and left side walls 29*a*, 29*a* of the arm member 29. Front surface of the body 21*a* is constricted by a belt 29*c* extended between front ends of the right and left side walls 29*a*, 29*a* of the arm member 29.

The water separator 21 is thus mounted, via the arm member 29 and the bracket 22, to the front lower part of the crankcase 5. Because the electronic equipment 20 and the water separator 21 are mounted to the engine through the rubber grommet 25, they become resistant to vibrations resulted from the engine drive.

As shown in FIG. 7, the water separator is comprised of a body 21*a* and a lid member 21*b* removably threaded with an upper part of the body 21*a*. The lid member 21*b*, as shown in FIG. 5, has a fuel inlet 21*c* and a fuel outlet 21*d* disposed in juxtaposition. A lead switch holder 21*f*, which accommodates a lead switch 21*g*, extends upwardly from a bottom 21*e* of the body 21*a* through the latter. Fitted over an outer periphery of the lead switch holder 21*f* is a ring-shaped magnet float 21*h*.

Fuel is fed through the fuel inlet 21*c* into the body 21*a* of the water separator 21 and lead out of the fuel outlet 21*d*. Water contained in the fuel is separated during the fuel flow.

Separated water is reserved in the body 21*a*. The level of reserved water is detected by a lead switch 21*g* that detects the rise of the magnet float 21*h*. When a time to discharge the separated water is indicated by, e.g., a lamp, a tube, not shown, is removed from the fuel inlet 21*c* and the fuel outlet 21*d*, followed by removing the lid member 21*b* from the body 21*a* so that the reserved water can be discharged from the body 21*a*.

As described above, the electronic equipment 20, which comprise plural relay switches with electrical contacts, is mounted via the rubber grommet (mount) 25 to the engine as a source of vibration. Thus, the electrical contacts of the electronic equipment 20 are freed from undesired effects of vibrations. This leads to the provision of an electrical-switch-mounting structure with increased vibration absorbing capacity. Further, since the lead switch 21*g* disposed in the water or fluid reserved within the water separator 21, it is protected from vibrations dually by the rubber mount 25 and the fluid.

Moreover, since the electronic equipment 20 is disposed below the intake port 6*a* formed in the lower surface of the intake silencer 6 which in turn is disposed on the front side of the outboard engine unit, air positioned located below the intake port 6*a* of the intake silencer 6 flows with the outside air taken in through the intake port 6*a* so that no air stands still around the electronic equipment 20. Consequently, the electronic equipment 20 is cooled efficiently and heat generation of the equipment 20 is suppressed.

Although, in the described embodiment, the electronic components are mounted to the front wall of the crankcase, this should not be construed as the sole mounting mode or position. For example, the electronic components may be mounted to the bracket which in turn is mounted via the rubber mount to the mount case for supporting the engine.

Obviously, various minor changes and modifications of the present invention are possible in light of the above teaching. It is therefore to be understood that within the scope of the appended claims the invention may be practiced otherwise than as specifically described.

What is claimed is:

1. An outboard engine unit comprising: an engine;

a fuel water separator;

a plurality of electronic components; and a single bracket for supporting the fuel water separator and the plural electronic components inclusive, wherein the bracket is mounted via a rubber mount to the engine or an engine support member.

2. The outboard engine unit of claim 1, wherein one of the plural electronic components comprises an electric contact accommodated within a fluid keeping case.

3. The outboard engine unit of claim 1, wherein the bracket is formed by press-forming a steel sheet and is U-shaped as viewed in a side elevation.

* * * * *